US009805678B2

(12) United States Patent
Im et al.

(10) Patent No.: US 9,805,678 B2
(45) Date of Patent: Oct. 31, 2017

(54) LIQUID CRYSTAL DISPLAY DEVICE HAVING WHITE PIXEL

(71) Applicant: Samsung Display Co., Ltd., Yongin-si, Gyeonggi-Do (KR)

(72) Inventors: Wan-Soon Im, Cheonan-si (KR); Hyoung Cheol Lee, Suwon-si (KR); Tae Kyung Yim, Seoul (KR); Jong Hak Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 20 days.

(21) Appl. No.: 14/798,725

(22) Filed: Jul. 14, 2015

(65) Prior Publication Data

US 2016/0180786 A1 Jun. 23, 2016

(30) Foreign Application Priority Data

Dec. 17, 2014 (KR) ..... 10-2014-0182299

(51) Int. Cl.
*G09G 3/36* (2006.01)

(52) U.S. Cl.
CPC ... *G09G 3/3659* (2013.01); *G09G 2300/0447* (2013.01); *G09G 2300/0452* (2013.01)

(58) Field of Classification Search
CPC ..... G09G 3/3659; G09G 2300/0447; G09G 2300/0452
See application file for complete search history.

(56) References Cited

U.S. PATENT DOCUMENTS 7,365,722 B2 * 4/2008 Lee ..... G09G 3/3607 345/690
7,705,934 B2 * 4/2010 Kurahashi ..... G02F 1/1347 345/4
7,911,541 B2 * 3/2011 Yamamoto ..... G09G 3/2092 345/77
7,916,244 B2 * 3/2011 Hur ..... G02F 1/133707 349/106
8,063,850 B2 * 11/2011 Lee ..... G02F 1/167 345/55
8,803,767 B2 * 8/2014 Phan ..... G09G 3/2003 345/55
9,091,884 B2 * 7/2015 Kim ..... G02F 1/13363
9,116,400 B2 * 8/2015 Song ..... G09G 3/3648
9,202,405 B2 * 12/2015 Liao ..... G09G 3/2003
9,361,841 B2 * 6/2016 Liao ..... G09G 3/3696
(Continued)

FOREIGN PATENT DOCUMENTS

JP 2007-206230 A 8/2007
KR 10-2004-0079562 A 9/2004
(Continued)

*Primary Examiner* — Peter D McLoone
(74) *Attorney, Agent, or Firm* — H.C. Park & Associates, PLC

(57) ABSTRACT

An exemplary embodiment of the present invention provides a display device including red pixels, blue pixels, green pixels, and white pixels, a plurality of gate lines, and a plurality of data lines, wherein the red pixels, the blue pixels, and the green pixels are disposed to longitudinally extend in a vertical direction, and the white pixels are disposed to longitudinally extend in a horizontal direction below or above the red pixels, the blue pixels, and the green pixels.

16 Claims, 8 Drawing Sheets

(56) References Cited

U.S. PATENT DOCUMENTS 9,377,657 B2 * 6/2016 Okazaki ..... G02F 1/134336
9,524,669 B2 * 12/2016 Sato ..... G09G 3/3233
9,536,481 B2 * 1/2017 Yoon ..... G09G 3/36
9,620,533 B2 * 4/2017 Kim ..... H01L 27/1251
2004/0046725 A1 * 3/2004 Lee ..... G09G 3/3607 345/88
2006/0268203 A1 * 11/2006 Kurahashi ..... G02F 1/1347 349/108
2007/0013649 A1 * 1/2007 Kim ..... G02F 1/133377 345/107
2007/0064162 A1 * 3/2007 Yamamoto ..... G09G 3/2092 348/790
2007/0176862 A1 * 8/2007 Kurt ..... G09G 3/2092 345/82
2008/0272987 A1 * 11/2008 Lee ..... G02F 1/167 345/55
2008/0316413 A1 * 12/2008 Cho ..... G02F 1/134309 349/144
2009/0207328 A1 * 8/2009 Hur ..... G02F 1/133707 349/37
2011/0102412 A1 * 5/2011 Yamamoto ..... G09G 3/2092 345/212
2012/0206512 A1 8/2012 Kim et al.
2012/0313842 A1 * 12/2012 Phan ..... G09G 3/2003 345/55
2012/0320173 A1 * 12/2012 Kim ..... G02F 1/13363 348/60
2013/0093657 A1 * 4/2013 Song ..... G09G 3/3648 345/92
2014/0204321 A1 * 7/2014 Koh ..... G02F 1/133514 349/109
2015/0138464 A1 * 5/2015 Okazaki ..... G02F 1/134336 349/37
2015/0187301 A1 * 7/2015 Yoon ..... G09G 3/36 345/88
2015/0228214 A1 * 8/2015 Liao ..... G09G 3/2003 345/84
2016/0063936 A1 * 3/2016 Liao ..... G09G 3/3696 345/694
2016/0070135 A1 * 3/2016 Im ..... G02F 1/133514 349/96
2016/0178954 A1 * 6/2016 Lim ..... G02F 1/13624 349/43
2016/0197104 A1 * 7/2016 Kim ..... H01L 27/1251 257/347

FOREIGN PATENT DOCUMENTS

KR 10-2005-0001722 A 1/2005
KR 10-2012-0093003 A 8/2012

* cited by examiner

LIQUID CRYSTAL DISPLAY DEVICE HAVING WHITE PIXEL

CLAIM OF PRIORITY

This application claims priority to and the benefit of Korean Patent Application No. 10-2014-0182299 filed in the Korean Intellectual Property Office on Dec. 17, 2014, the entire contents of which are incorporated herein by reference.

BACKGROUND OF THE INVENTION

1. Field of Disclosure

This disclosure relates to a liquid crystal display including a white pixel.

2. Description of the Related Art

A liquid crystal display (LCD) is one of the most widely used flat panel displays, and an LCD includes a pair of panels provided with field-generating electrodes and a liquid crystal (LC) layer interposed between the two panels. The LCD displays images by applying signals to the field-generating electrodes to generate an electric field in the LC layer that determines the orientation of LC molecules therein to adjust polarization of incident light.

The liquid crystal display includes a thin film transistor array panel and a common electrode panel facing each other. The thin film transistor array panel includes a gate line transmitting a gate signal and a data line transmitting a data signal and intersecting each other, a thin film transistor connected to the gate line and the data line, and a pixel electrode connected to the thin film transistor. The common electrode panel includes a light blocking member, a color filter, and a common electrode.

However, this liquid crystal display has some problems in visibility and viewing angle, and thus various modes of liquid crystal displays have been developed in order to solve the problems.

The above information disclosed in this Related Art section is only for enhancement of understanding of the background of the invention and therefore it may contain information that does not form the prior art that is already known to a person of ordinary skill in the art.

SUMMARY OF THE INVENTION

A method for disposing a white pixel as well as red, green, and blue pixels to improve luminance of a liquid crystal display is proposed. The luminance is improved by disposing the white pixel, but a moving vertical line defect occurs.

The present invention has been made in an effort to provide a liquid crystal display having no moving vertical line defect.

An exemplary embodiment of the present invention provides a display device including red pixels, blue pixels, green pixels, white pixels, a plurality of gate lines, and a plurality of data lines, wherein the red pixels, the blue pixels, and the green pixels are respectively disposed to longitudinally extend in a vertical direction, and the white pixels are disposed to longitudinally extend in a horizontal direction below or above the red pixels, the blue pixels, and the green pixels.

The red pixels, the blue pixels, and the green pixels may receive a gate control signal through a first gate line, the white pixels may receive a gate control signal through a second gate line, the first gate line may receive the gate control signal from a gate driving IC mounted in the display device, and the second gate line may receive the gate control signal from a gate driving circuit integrated in the display device.

One row of the white pixels may be disposed every two RGB pixel rows in which the red pixels, the blue pixels, and the green pixels are arranged.

The row of the white pixels may be disposed between the RGB pixel rows.

A same voltage may be applied to all the white pixels disposed in one row of the white pixels.

A same voltage may be applied to all the white pixels disposed in a predetermined number of rows of the white pixels.

Pixel electrodes of all the white pixels disposed in a predetermined number of rows of the white pixels may be electrically connected to each other.

A same voltage may be applied to all the white pixels of the display device.

According to the exemplary embodiment of the present invention, it is possible to provide a liquid crystal display having high luminance without having a moving vertical line defect.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
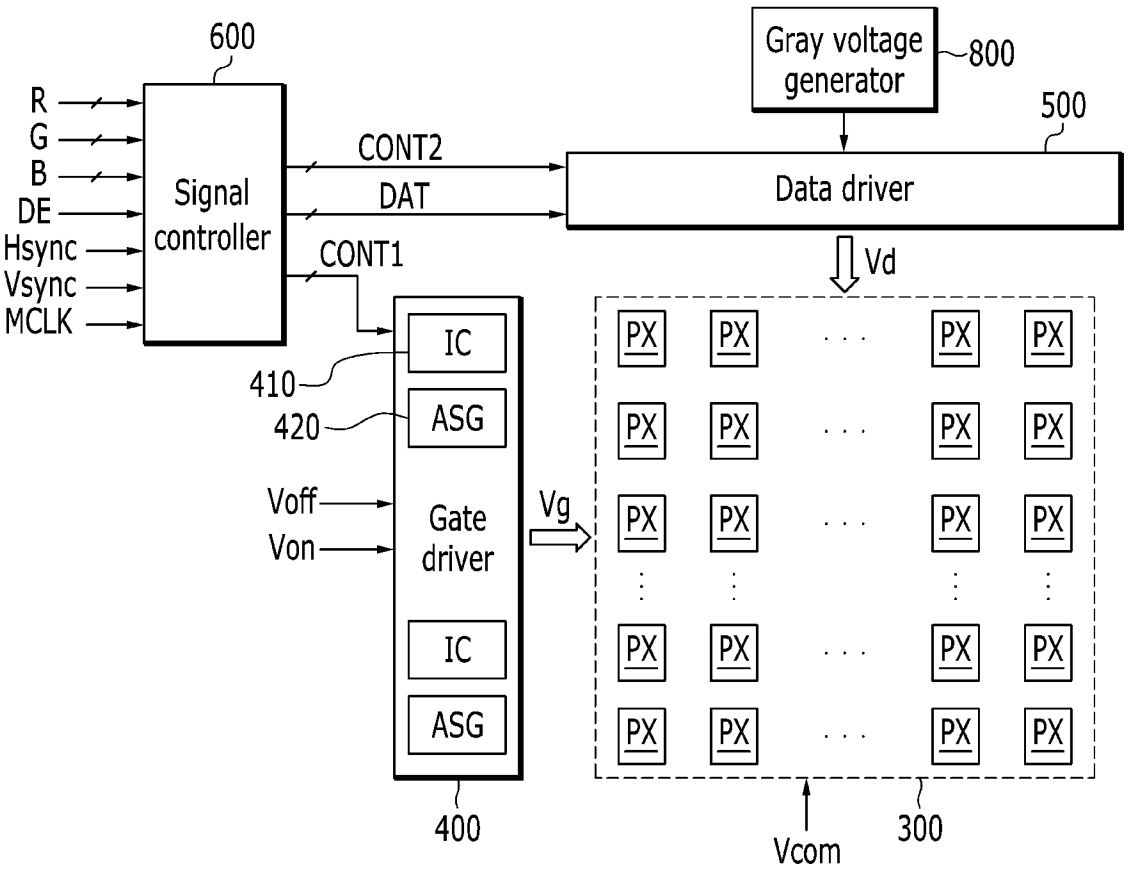
FIG. 1 is a block diagram illustrating a liquid crystal display according to an exemplary embodiment of the present invention.

The example embodiments are described more fully hereinafter with reference to the accompanying drawings. The inventive concept may, however, be embodied in many different forms and should not be construed as limited to the example embodiments set forth herein.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the drawings, the thickness of layers, films, panels, regions, etc., are exaggerated for clarity. Like reference numerals designate like elements throughout the specification.

A liquid crystal display according to an exemplary embodiment of the present invention will be described with the accompanying figures.

Figure 2:
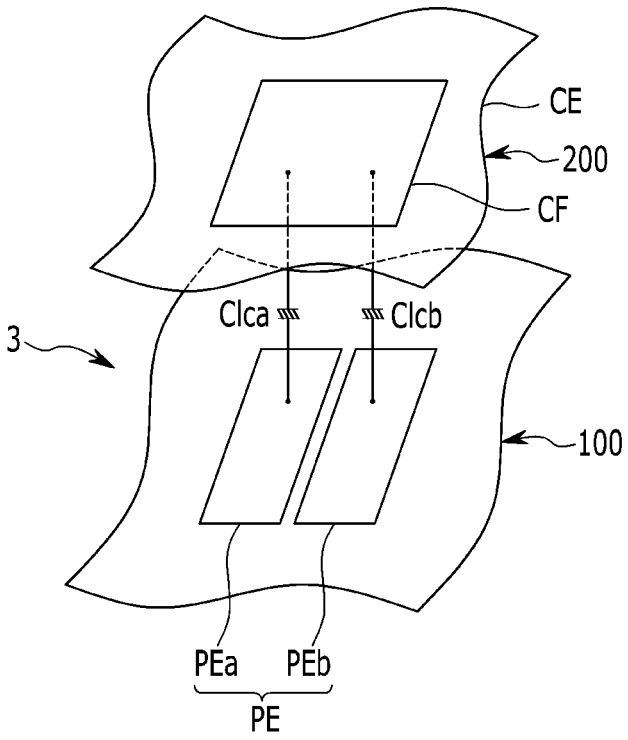
FIG. 2 is an equivalent circuit diagram illustrating a single pixel together with a structure of a liquid crystal display according to an exemplary embodiment of the present invention.

FIG. 1 is a block diagram illustrating a liquid crystal display according to an exemplary embodiment of the present invention, and FIG. 2 is an equivalent circuit diagram illustrating a single pixel together with a structure of a liquid crystal display according to an exemplary embodiment of the present invention.

As shown in FIG. 1, the liquid crystal display according to the exemplary embodiment of the present invention includes a liquid crystal panel assembly 300, a gate driver 400 and a data driver 500 connected to the liquid crystal panel assembly 300, a gray voltage generator 800 connected to the data driver 500, and a signal controller 600 for controlling the above components.

In an equivalent circuit, the liquid crystal panel assembly 300 includes a plurality of signal lines (not shown) and a plurality of pixels PX that are connected to the signal lines and are substantially arranged in a matrix. As seen from the structure shown in FIG. 2, the liquid crystal panel assembly 300 includes a thin film transistor array panel 100 and an opposing display panel 200 which face each other with a liquid crystal layer 3 interposed therebetween.

The signal lines include a plurality of gate lines (not shown) that transmit a gate signal (also referred to a "scan signal") and a plurality of data lines (not shown) that transmit a data signal. The gate lines are disposed to extend substantially in a row direction and to be substantially parallel to each other. Further, the data lines are disposed to extend substantially in a column direction and to be substantially parallel to each other.

Each of the pixels PX includes a pair of subpixels, and each of the subpixels includes liquid crystal capacitors Clca and Clcb. At least one of two subpixels includes a switching element (not shown) that may be connected to the gate line, the data line, and the liquid crystal capacitors Clca and Clcb.

The liquid crystal capacitors Clca and Clcb include a subpixel electrode PEa/PEb of the thin film transistor array panel 100 and a common electrode CE of the opposing display panel 200 as two terminals, and the liquid crystal layer 3 between the subpixel electrodes PEa/PEb and the common electrode CE serves as a dielectric material. The pair of subpixel electrodes PEa/PEb are separated from each other and constitute a single pixel electrode PE. The common electrode CE may be formed on an entire surface of the opposing display panel 200, and a common voltage Vcom is applied thereto. The liquid crystal layer 3 has negative dielectric anisotropy. The liquid crystal molecules of the liquid crystal layer 3 may be erected perpendicularly to the thin film transistor array panel 100 in a state of having no electric field.

Meanwhile, in order to realize color display, each pixel PX uniquely displays one of primary colors (spatial division) or each pixel PX temporally and alternately displays primary colors (temporal division). Then, the primary colors are spatially and temporally synthesized, and thus a desired color is recognized. Examples of the primary colors may include three primary colors of red, green, and blue. FIG. 2 shows an example of the spatial division. In FIG. 2, each pixel PX has a color filter CF that represents one of the primary colors in a region of the opposing display panel 200. Unlike FIG. 2, the color filter CF may be formed above or below the first and second subpixel electrodes PEa and PEb of the thin film transistor array panel 100.

At least one polarizer (not shown) for providing light polarization may be attached on outer surfaces of the liquid crystal panel assembly 300.

Again referring to FIG. 1, the gray voltage generator 800 generates all gray voltages or a limited number of gray voltages (hereinafter referred to as "reference gray voltages") related to transmittance of the pixels PX. The (reference) gray voltages may be positive or negative with respect to the common voltage Vcom.

The gate driver 400 includes a gate driving integrated circuit (IC) 410 and an amorphous silicon gate driving circuit (ASG) 420. The gate driving IC 410 may be embodied as a semiconductor chip that is separated from the thin film transistor array panel 100 to be mounted on the thin film transistor array panel 100, and the amorphous silicon gate driving circuit 420 is formed together in a process for forming a thin film transistor, the subpixel electrodes PEa and PEb, and the like on the thin film transistor array panel 100. The gate driving IC 410 and the amorphous silicon gate driving circuit 420 are connected to the gate lines of the liquid crystal panel assembly 300 to apply a gate signal Vg formed of a combination of gate-on voltages Von and gate-off voltages Voff to the gate lines. The gate driving IC 410 may apply a gate signal Vg to the gate lines connected to the red pixel, the blue pixel, and the green pixel, and the amorphous silicon gate driving circuit 420 may apply the gate signal Vg to the gate line connected to the white pixel.

The data driver 500 may be connected to the data line of the liquid crystal panel assembly 300, and selects a gray voltage from the gray voltage generator 800 and applies the gray voltage as the data voltage to the data line. However, when the gray voltage generator 800 does not provide the voltage for all gray levels, but provides a predetermined number of reference gray voltages, the data driver 500 divides the reference gray voltages to generate gray voltages for all gray levels and then selects a data signal from among them.

The signal controller 600 includes an image signal converter (not shown), and controls the gate driver 400 and the data driver 500.

Such drivers 400, 500, 600, and 800 may be directly installed on the liquid crystal panel assembly 300 as a form of at least one IC chip or installed on a flexible printed circuit film (not shown) to be attached on the liquid crystal panel assembly 300 as a form of a tape carrier package (TCP), or installed on a separate printed circuit board (PCB) (not shown). Alternatively, the above-mentioned drivers 400, 500, 600, and 800 may be integrated in the liquid crystal panel assembly 300 together with the signal line and the thin film transistor switching element. Further, the drivers 400, 500, 600, and 800 may be integrated as a single chip. In this case, at least one driver or at least one circuit element that constitutes the driver may be disposed outside the single chip.

Next, a liquid crystal display according to an exemplary embodiment of the present invention will be described with reference to FIG. 3 to FIG. 6 as well as FIG. 1 and FIG. 2.

Figure 3:
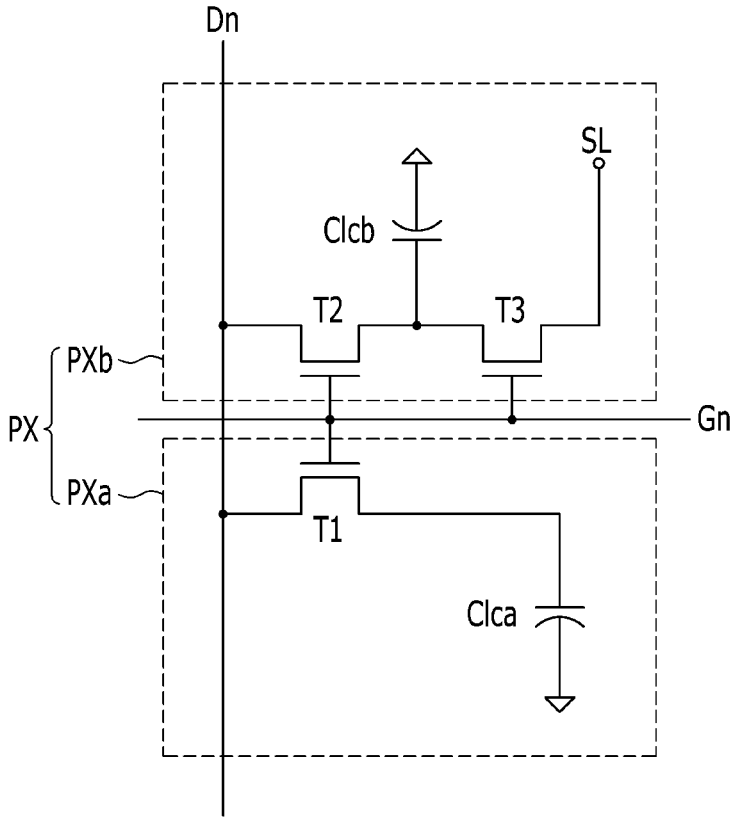
FIG. 3 is an equivalent circuit diagram of a single pixel of a liquid crystal display according to an exemplary embodiment of the present invention.
Figure 4:
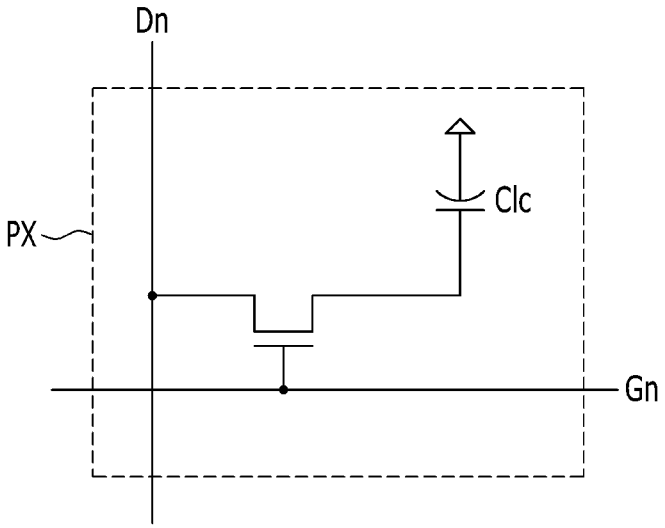
FIG. 4 is an equivalent circuit diagram of a single pixel of a liquid crystal display according to an exemplary embodiment of the present invention.
Figure 5:
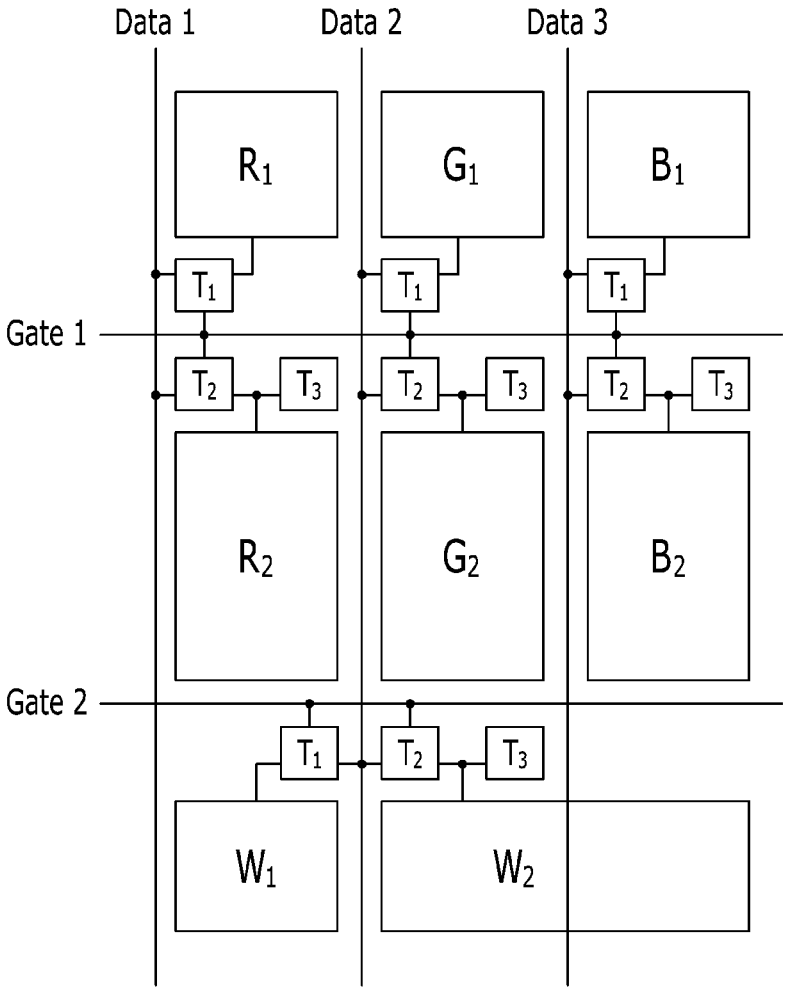
FIG. 5 is a layout view of red, green, and blue pixels of a liquid crystal display according to an exemplary embodiment of the present invention.
Figure 6:
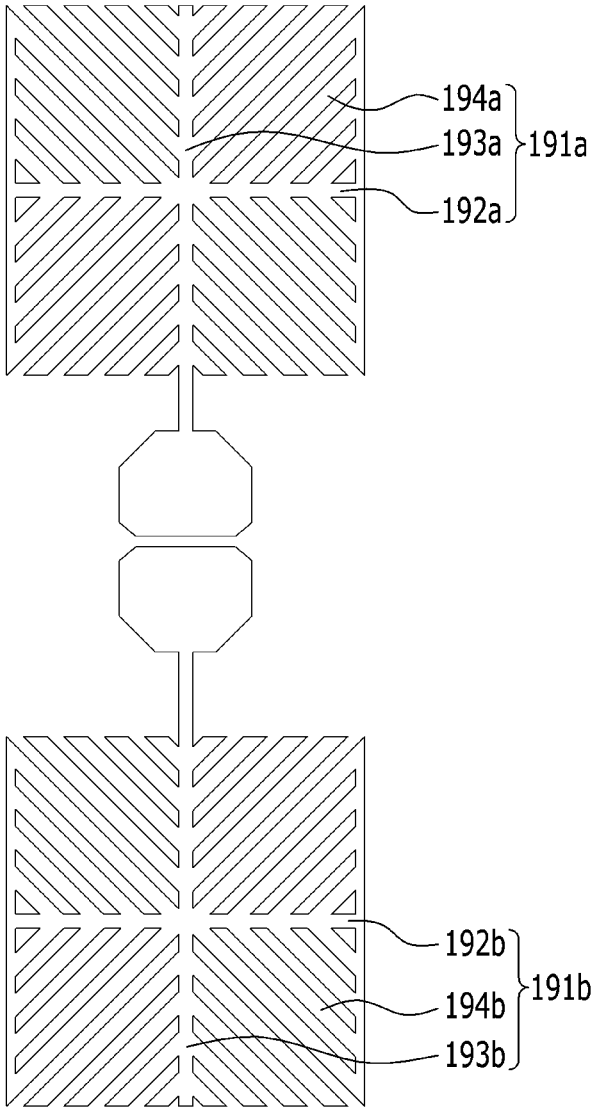
FIG. 6 is a layout view of a pixel electrode of a liquid crystal display according to an exemplary embodiment of the present invention.

FIG. 3 is an equivalent circuit diagram of a single pixel of a liquid crystal display according to an exemplary embodiment of the present invention, FIG. 4 is an equivalent circuit diagram of a single pixel of a liquid crystal display according to an exemplary embodiment of the present invention, FIG. 5 is a layout view of red, green, and blue pixels of a liquid crystal display according to an exemplary embodiment of the present invention, and FIG. 6 is a layout view of a pixel electrode of a liquid crystal display according to an exemplary embodiment of the present invention.

Referring to FIG. 1 and FIG. 3, the liquid crystal display according to the exemplary embodiment of the present invention includes a plurality of signal lines Gn, Dn, and SL and a plurality of pixels PX connected thereto.

The signal lines Gn, Dn, and SL include a gate line Gn that transmits a gate signal (also referred to as a "scan signal"), a data line Dn that transmits a data voltage, and a storage electrode line SL to which a constant voltage may be applied.

A first thin film transistor T1 and a second thin film transistor T2 that are connected to the same gate line Gn and the same data line Dn are formed. Further, a third thin film transistor T3 is formed so as to be connected to the same gate line Gn as that of the transistors T1 and T2 and to be connected to the second thin film transistor T2 and the storage electrode line SL.

Each pixel PX includes two subpixels PXa and PXb. A first liquid crystal capacitor Clca that may be connected to the first thin film transistor T1 may be formed in the first subpixel PXa. Further, a second liquid crystal capacitor Clcb that may be connected to the second thin film transistor T2 may be formed in the second subpixel PXb.

A first terminal of the first thin film transistor T1 may be connected to the gate line Gn, a second terminal thereof may be connected to the data line Dn, and a third terminal thereof may be connected to the first liquid crystal capacitor Clca. A first terminal of the second thin film transistor T2 may be connected to the gate line Gn, a second terminal thereof may be connected to the data line Dn, and a third terminal thereof is connected to the second liquid crystal capacitor Clcb. A first terminal of the first thin film transistor T3 may be connected to the gate line Gn, a second terminal thereof may be connected to the third terminal of the second thin film transistor T2, and a third terminal thereof may be connected to the storage electrode line SL.

In the operation of the liquid crystal display according to an exemplary embodiment of the present invention, when the gate-on voltage may be applied to the gate line Gn, the first, second, and third thin film transistors T1, T2, and T3 connected thereto are turned on, and the first liquid crystal capacitor Clca and the second liquid crystal capacitor Clcb are charged by the data voltage transmitted through the data line Dn.

In this case, since the third thin film transistor T3 is turned on, some of voltages charged in the second liquid crystal capacitor Clcb are leaked through the storage electrode line SL. Accordingly, even though the data voltages that are transmitted to the first subpixel PXa and the second subpixel PXb through the data line Dn are equal to each other, the voltages that are charged in the first liquid crystal capacitor Clca and the second liquid crystal capacitor Clcb are different from each other. That is, the voltage that is charged in the second liquid crystal capacitor Clcb is lower than the voltage that is charged in the first liquid crystal capacitor Clca. Accordingly, it is possible to improve side visibility by charging different subpixels PXa and PXb in the same pixel PX with different voltages.

Hitherto, the structure in which the two liquid crystal capacitors Clca and Clcb and the three thin film transistors T1, T2, and T3 are disposed at one pixel and the two liquid crystal capacitors Clca and Clcb are charged with different voltages has been described. However, as illustrated in FIG. 4, the present invention may be applied to a structure in which one liquid crystal capacitor Clc and one thin film transistor are disposed at one pixel. Some exemplary embodiments will be descried below by using the structure in which the two liquid crystal capacitors Clca and Clcb and the three thin film transistors T1, T2, and T3 are disposed at one pixel.

Disposition of red, green, and blue pixels and a shape of a pixel electrode in a liquid crystal display according to an exemplary embodiment of the present invention will be described in more detail with reference to FIG. 5 and FIG. 6.

Referring to FIG. 5, a red pixel, a green pixel, and a blue pixel are longitudinally disposed in a direction of data lines. In the case of the red pixel, the green pixel, and the blue pixel, first subpixel electrodes R1, G1, and B1 and second subpixel electrodes R2, G2, and B2 are respectively disposed at an upper side and a lower side of a first gate line Gate 1, and three thin film transistors T1, T2, and T3 are disposed around the first gate line Gate 1 to receive a gate control signal from the first gate line Gate 1. The first gate line Gate 1 may be connected to the gate driving IC 410 of the gate driver 400 to receive the gate control signal therefrom.

A white pixel may be longitudinally disposed below the red, green, and blue pixels in a horizontal direction. A first subpixel electrode W1 and a second subpixel electrode W2 of the white pixel are respectively disposed at opposite sides with reference to the second data line Data 2. Three thin film transistors T1, T2, and T3 are disposed around the second gate line Gate 2, and control terminals thereof are connected to the second gate line Gate 2 to receive a gate control signal therefrom. The second gate line Gate 2 may be connected to the amorphous silicon gate driving circuit 420 of the gate driver 400 to receive the gate control signal therefrom.

Through this pixel disposition, it is possible to prevent a moving vertical line defect from being generated.

The subpixel electrodes of the red, green, and blue pixels and the white pixels may have a slit structure as shown in FIG. 6.

Referring to FIG. 6, a first subpixel electrode 191*a* neighbors a second subpixel electrode 191*b* in a column direction, and they respectively include a cross-shaped branch unit having a quadrangular shape and including horizontal stems 192*a* and 192*b* and vertical stems 193*a* and 193*b* crossing the horizontal stems 192*a* and 192*b*. Further, the first subpixel electrode 191*a* and the second subpixel electrode 191*b* are respectively divided into four subregions by the horizontal stems 192*a* and 192*b* and the vertical stems 193*a* and 193*b*, and each subregion includes a plurality of minute branches 194*a* and 194*b*.

One of the minute branches 194*a* and 194*b* disposed at the four subregions is disposed to obliquely extend from the horizontal stems 192*a* and 192*b* or the vertical stems 193*a* and 193*b* in an upper left direction, and another minute branch may be disposed to obliquely extend from the horizontal stems 192*a* and 192*b* or the vertical stems 193*a* and 193*b* in an upper right direction. Further, another minute branch may be disposed to obliquely extend from the horizontal stems 192*a* and 192*b* or the vertical stems 193*a* and 193*b* in a lower left direction, and the other minute branch may be disposed to obliquely extend from the horizontal stems 192*a* and 192*b* or the vertical stems 193*a* and 193*b* in a lower right direction.

Each of the minute branches 194*a* and 194*b* form an angle of approximately 40° to 45° with the horizontal stems 192*a* and 192*b* or the gate line 121. Further, the minute branches 194*a* and 194*b* of two adjacent subregions may be perpendicular to each other.

Figure 7:
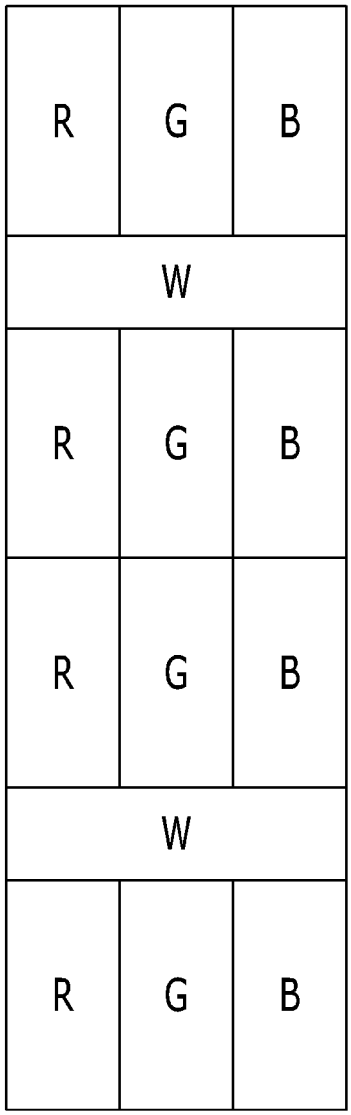
FIG. 7 is a layout view of a pixel of a liquid crystal display according to an exemplary embodiment of the present invention.

FIG. 7 is a layout view of a pixel of a liquid crystal display according to an exemplary embodiment of the present invention.

Referring to FIG. 7, a set of a red pixel R, a green pixel G, and a blue pixel B is disposed at an upper side and a lower side with reference to one white pixel W. The white pixel W displays one point image together with the upper set of the red pixel R, the green pixel G, and the blue pixel B, and displays another point image together with the lower set of the red pixel R, the green pixel G, and the blue pixel B. In this case, white component that is supposed to be displayed by combination of the red pixels R, the green pixels G, and the blue pixels B included in the upper and lower sets are displayed at the white pixel, and the rest of the red, green, and blue components are displayed at the red pixels R, the green pixels G, and the blue pixels B included in the upper and lower sets.

With this pixel disposition, it is possible to reduce the number of white pixel rows by half, thereby reducing the number of gate lines by as much as the reduced number of the white pixel rows.

Figure 8:
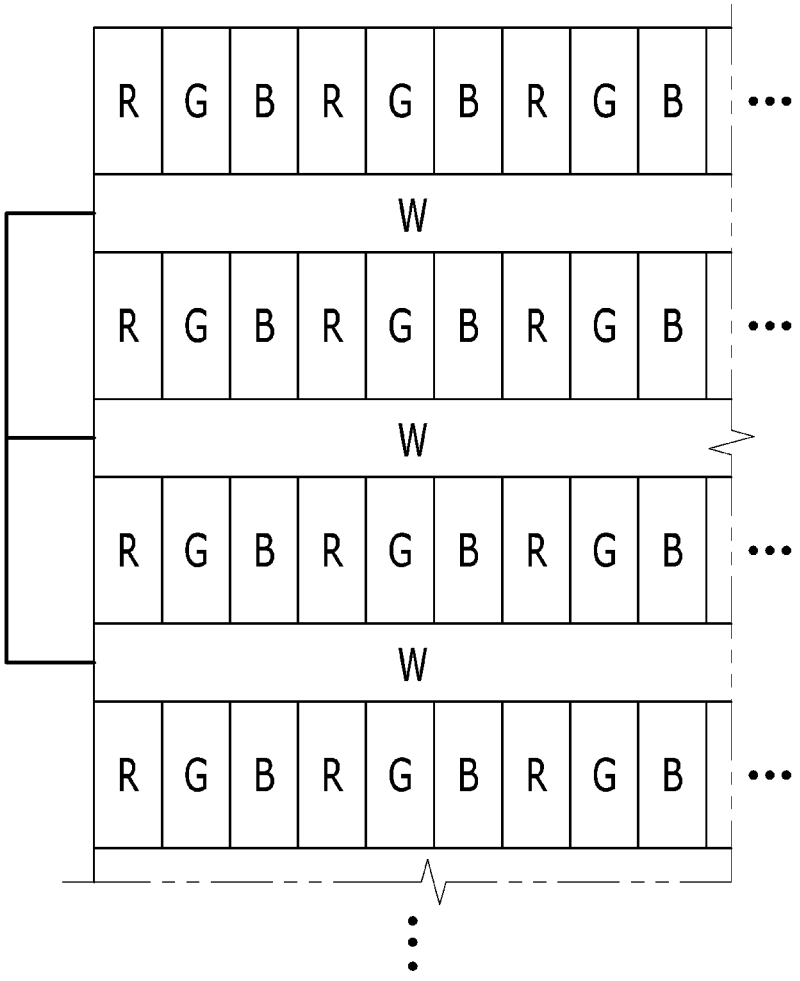
FIG. 8 is a layout view of a pixel of a liquid crystal display according to an exemplary embodiment of the present invention.

FIG. 8 is a layout view of a pixel of a liquid crystal display according to an exemplary embodiment of the present invention.

Referring to FIG. 8, one white pixel row is operated like one pixel. An electrode may be formed to have a band-like shape, and a white image signal voltage may be applied to the electrode. Further, as shown in FIG. 5 or FIG. 7, the white pixels W may be separately formed, and the same voltage may be applied per row.

In addition, as shown in FIG. 8, three white pixel rows are connected to each other. Accordingly, the same voltage may be applied to the three white pixel rows. The number of white pixel rows may be adjusted as necessary, and all of the white pixel rows of the display device may be connected to each other. In this case, the white pixel rows display lowest luminance of white components that are required to be commonly displayed at portions at which the white pixel rows connected to each other are disposed, and the other components are displayed through the red pixels R, the green pixels G, and the blue pixels B.

Hitherto, the present invention has been described by using the case of a liquid crystal display as a display device, but it may be applied to various display devices such as an organic light emitting device.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

red pixels, blue pixels, green pixels, white pixels, a plurality of gate lines, and a plurality of data lines, wherein the red pixels, the blue pixels, and the green pixels are respectively disposed to longitudinally extend in a vertical direction, and the white pixels are disposed to longitudinally extend in a horizontal direction below or above the red pixels, the blue pixels, and the green pixels, wherein one row of the white pixels is disposed for every two RGB pixel rows in which the red pixels, the blue pixels, and the green pixels are arranged, wherein there is two rows of RGB pixels interposed between every two neighboring rows of white pixels, wherein the row of the white pixels is disposed between the RGB pixel rows, wherein a same image signal voltage from one of the data lines is applied to all the white pixels disposed in one row of the white pixels.

2. The display device of claim 1, wherein a same voltage is applied to all the white pixels disposed in a predetermined number of rows of the white pixels said predetermined number of rows being at least two.

3. The display device of claim 2, wherein a same data voltage from one of the data lines is applied to all the white pixels of the display device at any point in time.

4. The display device of claim 1, wherein pixel electrodes of all the white pixels disposed in a predetermined number of rows of the white pixels are electrically connected to each other.

5. The display device of claim 1, wherein pixel electrodes of all the white pixels disposed in one row of the white pixels are electrically connected to each other.

6. The display device of claim 1, wherein one row of the white pixels is arranged for every two RGB pixel rows in which the red pixels, the blue pixels, and the green pixels are arranged, wherein two RGB pixel rows are arranged between two neighboring rows of white pixels.

7. The display device of claim 6, wherein the row of the white pixels is disposed between the RGB pixel rows.

8. The display device of claim 1, wherein white pixels are only arranged in rows containing only white pixels, wherein red pixels, green pixels and blue pixels are only arranged in rows that do not contain white pixels.

9. A display device, comprising:

red pixels, blue pixels, green pixels, white pixels, a plurality of gate lines, and a plurality of data lines, wherein the red pixels, the blue pixels, and the green pixels are respectively disposed to longitudinally extend in a vertical direction, and the white pixels are disposed to longitudinally extend in a horizontal direction below or above the red pixels, the blue pixels, and the green pixels, wherein one row of the white pixels is disposed for every two RGB pixel rows in which the red pixels, the blue pixels, and the green pixels are arranged, wherein there is two rows of RGB pixels interposed between every two neighboring rows of white pixels, wherein a same voltage is applied to all the white pixels disposed in one row of the white pixels, wherein the row of the white pixels is operated like one pixel.

10. The display device of claim 9, wherein a same voltage is applied to all the white pixels disposed in a predetermined number of rows of the white pixels, wherein the predetermined number of rows of the white pixels is operated like a single pixel, wherein the predetermined number is at least two.

11. The display device of claim 10, wherein a same voltage is applied to all the white pixels of the display device, wherein all of the white pixels of the display device is operated like a single pixel.

12. A display device having a liquid crystal panel assembly, comprising:

a plurality of gate lines;

a plurality of data lines; and a plurality of rows of pixels, comprising:

a first row of pixels consisting of a plurality of red pixels, a plurality of blue pixels, and a plurality of green pixels;

a second row of pixels immediately adjacent to the first row of pixels and in direct contact with the first row of pixels consisting of a plurality of red pixels, a plurality of blue pixels, and a plurality of green pixels; and a third row of pixels immediately adjacent to the second row of pixels and in direct contact with the second row of pixels consisting of a plurality of white pixels, wherein a pattern of the first, second and third row of pixels repeats until the liquid crystal panel assembly is filled, wherein the first and second rows of pixels receive a gate control signal solely through a first gate line of the plurality of gate lines, the third row of pixels receives another gate control signal solely through a second gate line of the plurality of gate lines, the first gate line receives the gate control signal solely from a gate driving IC mounted in the display device, and the second gate line receives the gate control signal from a gate driving circuit integrated in the display device, said first and second gate lines are separate lines, and said plurality of data lines are connected to the first, second, and third row of pixels.

13. The display device of claim 12, wherein a same voltage is applied to all the plurality of white pixels disposed in the third row of pixels.

14. The display device of claim 12, wherein a same voltage is applied to all the plurality of white pixels disposed in the liquid crystal panel assembly.

15. The display device of claim 12, wherein a same voltage is applied to all the white pixels disposed in a predetermined number of the third rows.

16. The display device of claim 12, wherein pixel electrodes of all the white pixels disposed in a predetermined number of the third rows are electrically connected to each other.

* * * * *